US008380361B2

(12) United States Patent
Evans

(10) Patent No.: US 8,380,361 B2
(45) Date of Patent: Feb. 19, 2013

(54) SYSTEM, METHOD, AND COMPUTER READABLE MEMORY MEDIUM FOR REMOTELY CONTROLLING THE MOVEMENT OF A SERIES OF CONNECTED VEHICLES

(75) Inventor: Jay Evans, Cocoa, FL (US)

(73) Assignee: General Electric Company, Schenectady, NY (US)

( * ) Notice: Subject to any disclaimer, the term of this patent is extended or adjusted under 35 U.S.C. 154(b) by 1028 days.

(21) Appl. No.: 12/139,805

(22) Filed: Jun. 16, 2008

(65) Prior Publication Data

US 2009/0312890 A1 Dec. 17, 2009

(51) Int. Cl.
*B61L 27/00* (2006.01)

(52) U.S. Cl. ..... 701/2; 701/19; 701/20; 701/36; 701/70; 701/93; 701/117; 246/2 R; 246/3; 246/4; 246/14; 246/15; 246/20; 246/27; 246/167 R; 246/182 B; 246/186; 303/18; 303/121; 303/22.6

(58) Field of Classification Search ..... 701/2, 11, 701/19, 20, 300; 246/1 R, 182 R; 340/901, 340/905

See application file for complete search history.

(56) References Cited

U.S. PATENT DOCUMENTS 3,519,805 A * 7/1970 Thorne-Booth ..... 701/70
3,639,754 A * 2/1972 Kovalcik et al. ..... 246/182 B
3,727,046 A * 4/1973 Woods et al. ..... 246/182 C
3,728,539 A * 4/1973 Thorne-Booth ..... 246/182 B
3,740,549 A * 6/1973 Thorne-Booth ..... 246/122 R
3,794,977 A * 2/1974 Thorne-Booth et al. ... 340/12.18
3,974,992 A * 8/1976 Matty ..... 246/182 B
4,005,838 A * 2/1977 Grundy ..... 246/182 B
4,066,230 A * 1/1978 Nohmi et al. ..... 246/182 B
4,066,877 A * 1/1978 Virnot et al. ..... 701/25
4,093,162 A * 6/1978 Takaoka et al. ..... 701/20
4,095,764 A * 6/1978 Osada et al. ..... 246/182 B
4,208,717 A * 6/1980 Rush ..... 701/20
4,327,415 A * 4/1982 Rush et al. ..... 701/117
4,360,875 A * 11/1982 Behnke ..... 455/456.5
4,562,543 A * 12/1985 Zuber et al. ..... 701/20
4,674,054 A * 6/1987 Ikeda et al. ..... 700/211

(Continued)

FOREIGN PATENT DOCUMENTS

WO WO 2006/093536 9/2006

OTHER PUBLICATIONS

Boutonnet et al., "Les Locotracteurs Telecommandables Sont En Service," Revue Generale des Chemins de Fer, Centrale des Revues, Oct. 1, 1990, pp. 23-28, No. 10, Paris, France.

*Primary Examiner* — Jonathan M Dager
(74) *Attorney, Agent, or Firm* — GE Global Patent Operation; John A. Kramer

(57) ABSTRACT

A remote control system for controlling movement of a train comprises one or more sensors positioned relative to a railroad track for detecting the presence of a lead railcar on the track being pushed by a remotely controllable locomotive. The one or more sensors are spaced a distance from a predetermined stop location of a lead railcar and transmit signals when the lead railcar is detected on the track. A programmable controller positioned off-board or wayside receives signals from the one or more sensors and is in radio communication with an onboard operating system of the locomotive. The controller transmits a signal to the locomotive when the lead railcar is detected by a sensor, and in response to the signal the operating system of the locomotive sets a maximum speed setting for the locomotive to travel on the track toward the stop location.

39 Claims, 2 Drawing Sheets

U.S. PATENT DOCUMENTS 4,835,693 A * 5/1989 Smith et al. ..... 701/70
5,039,038 A * 8/1991 Nichols et al. ..... 246/3
5,437,422 A * 8/1995 Newman ..... 246/5
5,452,870 A * 9/1995 Heggestad ..... 246/182 R
5,533,695 A * 7/1996 Heggestad et al. ..... 246/62
5,685,507 A * 11/1997 Horst et al. ..... 246/187 A
6,135,396 A * 10/2000 Whitfield et al. ..... 246/182 R
6,400,281 B1 * 6/2002 Darby et al. ..... 340/933
6,587,763 B2 * 7/2003 Ishikawa ..... 701/19
6,658,331 B2 * 12/2003 Horst et al. ..... 701/19
6,701,228 B2 * 3/2004 Kane et al. ..... 701/19
6,799,097 B2 * 9/2004 Villarreal Antelo et al. ... 701/19
6,856,865 B2 * 2/2005 Hawthorne ..... 701/19
6,970,774 B2 * 11/2005 Kane et al. ..... 701/19
6,996,461 B2 * 2/2006 Kane et al. ..... 701/19
6,997,418 B1 * 2/2006 Sanzone ..... 246/167 R
7,036,774 B2 * 5/2006 Kane et al. ..... 246/167 R
7,069,122 B1 * 6/2006 Higgs ..... 701/19
7,117,137 B1 * 10/2006 Belcea ..... 703/8
7,127,631 B2 * 10/2006 D'Angelo et al. ..... 713/502
7,201,350 B2 * 4/2007 Sugita et al. ..... 246/122 R
7,233,844 B2 * 6/2007 Peltz et al. ..... 701/19
7,236,860 B2 * 6/2007 Kane et al. ..... 701/20
7,520,472 B2 * 4/2009 Peltz et al. ..... 246/187 A
7,529,201 B2 * 5/2009 Aiken et al. ..... 370/278
7,715,956 B2 * 5/2010 Bryant ..... 701/19
7,756,613 B2 * 7/2010 Katsuta et al. ..... 701/19
7,792,089 B2 * 9/2010 Aiken et al. ..... 370/347
7,797,088 B2 * 9/2010 Philp et al. ..... 701/19
7,937,193 B2 * 5/2011 Philp et al. ..... 701/19
2002/0027495 A1 * 3/2002 Darby et al. ..... 340/298
2002/0107616 A1 * 8/2002 Delaruelle ..... 701/19
2002/0169530 A1 * 11/2002 Laguer-Diaz et al. ..... 701/35
2002/0180264 A1 * 12/2002 Moffitt ..... 303/128
2003/0040853 A1 * 2/2003 Brousseau et al. ..... 701/19
2003/0178534 A1 * 9/2003 Peltz et al. ..... 246/187 A
2003/0214417 A1 * 11/2003 Peltz et al. ..... 340/825
2003/0236598 A1 * 12/2003 Villarreal Antelo et al. ... 701/19
2004/0064223 A1 * 4/2004 Horst et al. ..... 701/19
2004/0111722 A1 * 6/2004 Horst et al. ..... 717/168
2005/0010338 A1 * 1/2005 Kraeling et al. ..... 701/19
2005/0125113 A1 * 6/2005 Wheeler et al. ..... 701/19
2005/0253022 A1 * 11/2005 Peltz et al. ..... 246/187 A
2006/0012246 A1 * 1/2006 Smith et al. ..... 303/155
2006/0085103 A1 * 4/2006 Smith et al. ..... 701/19
2007/0146159 A1 * 6/2007 Kato et al. ..... 340/825.49
2008/0068164 A1 * 3/2008 Campbell ..... 340/572.1
2008/0109124 A1 * 5/2008 Daum et al. ..... 701/19
2008/0128562 A1 * 6/2008 Kumar et al. ..... 246/186
2008/0154451 A1 * 6/2008 Dibble et al. ..... 701/20
2010/0130124 A1 * 5/2010 Teeter et al. ..... 455/15
2010/0204858 A1 * 8/2010 Bryant ..... 701/19
2010/0262321 A1 * 10/2010 Daum et al. ..... 701/20

* cited by examiner

SYSTEM, METHOD, AND COMPUTER READABLE MEMORY MEDIUM FOR REMOTELY CONTROLLING THE MOVEMENT OF A SERIES OF CONNECTED VEHICLES

BACKGROUND OF THE INVENTION

Embodiments of the invention relate generally to locomotives and other vehicles. More specifically, embodiments of the invention pertain to controlling the movement of locomotives.

When a railcar in a train reaches a destination (e.g., the train might include one or more locomotives and a plurality of railcars), a locomotive operator must stop the locomotive so the railcar is positioned at a predetermined stopping point for unloading the railcar cargo. A locomotive operator can remotely control the movement of the locomotive and railcars via an off-board remote control unit. Such remote control units have an operator interface that enables an operator to transmit commands to an onboard slave control unit that is interfaced with the locomotive onboard operating system. These commands generally relate to locomotive movement parameters such as direction of movement, speed, or braking. The remote control unit communicates with the locomotive operating system and/or slave control unit via a radio frequency (RF) communication system.

However, often times an operator commands the locomotive to move too fast and the locomotive is unable to stop the lead railcar before it passes the predetermined stopping point. As a result, the train may collide with and damage loading docks and nearby equipment, and/or damage the railcar. At present, there is not a method or system that provides the automated speed control and stopping of a locomotive and train, when the locomotive is pushing railcars so a lead railcar is properly positioned at a predetermined stopping point for unloading.

Radio frequency identification (RFID) or automated equipment identification (AEI) tags and readers are used to control movement of trains in rail yards. Specially programmed RFID or AEI tags are sometimes mounted on the tracks between the rails to identify speed limits and stopping points for when the locomotive is pulling cars. The locomotive has an RFID or AEI tag reader installed underneath it to read the tags as it crosses over them. This method of controlling a Remote Control Locomotive movement is not applicable to delivery of railcars to an industry location in which the locomotive is pushing or pulling the cars. Railcars cannot be practically equipped with a RFID reader as it requires a power source and radio for a communication link with the locomotive.

In addition, the tracks at rail yards and other destination locations are often times in very poor condition; therefore, systems having components mounted on the track rails such as impedance circuits may not serve as adequate solutions.

BRIEF DESCRIPTION OF THE INVENTION

Embodiments of the invention relate to systems and methods for controlling the movement of a series of connected vehicles that travel along a designated pathway. One of the vehicles is a powered vehicle for moving the series of vehicles. At least one sensor is positioned relative to the pathway for detecting the presence of a lead vehicle on the pathway, and one sensor is spaced a distance from a stop location of the lead vehicle. The sensor transmits at least one signal when the lead vehicle is detected on the pathway. A controller receives the signals from the sensor and is in communication with an onboard operating system of the powered vehicle. The controller transmits a signal to powered vehicle when the lead vehicle is detected by the sensor, and in response to the signal the operating system of the powered vehicle sets a maximum speed setting for the powered vehicle to travel on the pathway toward the stop location.

In another embodiment, the system may include a plurality of sensors positioned relative to the pathway, spaced apart from one another and spaced a predetermined distance from the stop location of the lead vehicle. As the lead vehicle approaches the stop location, the controller transmits a signal to the powered vehicle each time a sensor detects the lead vehicle on the pathway. Responsive to each signal the onboard operating system of the powered vehicle provides a maximum speed setting for the powered vehicle each time a sensor detects the lead vehicle on the pathway. The maximum speed setting is reduced as the lead vehicle approaches the stop location and trips successive sensors. At the last sensor, or the sensor closest to the stop location, the controller transmits a signal responsive to which the powered vehicle stops a distance from the stop location and the onboard operating system sets a maximum speed setting for the powered vehicle to travel toward the stop location.

BRIEF DESCRIPTION OF THE DRAWINGS

The present invention can be more easily understood and the further advantages and uses thereof more readily apparent, when considered in view of the following detailed description when read in conjunction with the following figures, wherein.

DETAILED DESCRIPTION OF THE INVENTION

Figure 1:
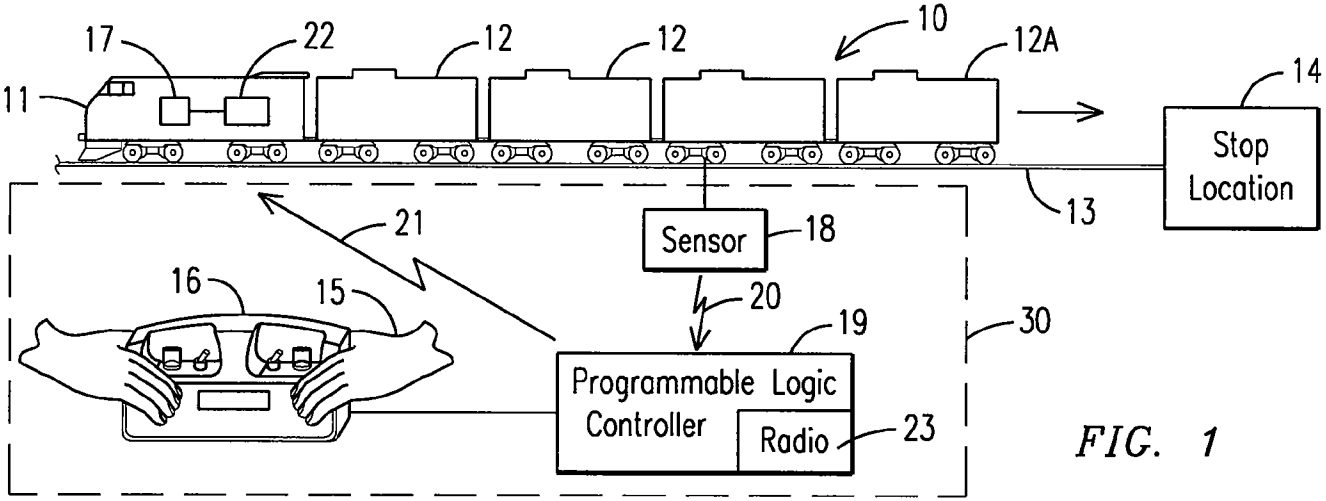
FIG. 1 is a schematic illustration of a first embodiment of the invention.

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained in the context of a locomotive that is pushing a plurality of railcars on a railroad track. However the invention is not so limited but encompasses remotely controlling the movement of a series of connected vehicles that include a powered vehicle that is pushing or pulling the other vehicles on a designated pathway. Accordingly, the invention may be applicable to off-highway vehicles, marine vehicles, on-road vehicles, etc. The term "powered vehicle" as used herein shall comprise the vehicles that have an onboard power source sufficient to propel the vehicle and others in a series of vehicles. In the case of trains traveling on railroad tracks, the locomotive is the powered vehicle. If the locomotive is pulling the railcars, the locomotive is also the "lead vehicle" or "lead railcar" as described below. If the locomotive is pushing the railcars the lead railcar is the railcar disposed at the end of the train opposite the locomotive Before describing in detail the particular method and apparatus for remotely controlling of movement of a train in accordance with the present invention, it should be observed that the present invention resides primarily in a novel combination of hardware and software elements related to said method and apparatus. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

With respect to FIG. 1 there is schematically shown a train 10 including a locomotive 11 pushing a plurality of railcars 12. The railcars 12 include a lead railcar 12A that is positioned at an end of the train 10 distal the locomotive 11. The locomotive 11 is pushing the railcars 12 (including the lead railcar 12A) on a track 13 toward a stop location 14 where the lead railcar 12A will be positioned for unloading or loading cargo. The track 13 is dedicated to the stop location 14 for unloading or loading a railcar 12, and is linked to a main track (not shown).

The locomotive 11 is remotely controlled by an operator 15 using a hand held remote control unit 16 that includes an operator interface having various input mechanisms that enable the operator to input commands relative to movement of the locomotive 11 and train 10. The remote control unit 16 is linked with a radio frequency module 17 (representing the onboard communication system) on the locomotive 11 that is a component of the locomotive 11 communications and power distribution system of the locomotive. For example, an operator may control the speed, stopping, and direction of the locomotive 11 by inputting commands in the remote control unit 16. The operator 15, via the remote control unit 16, transmits commands to an onboard operating system 22 to control movement on the locomotive 11 and train 10 on the track 13.

In an embodiment of the disclosed invention, a remote control system 30 is used to restrict the speed of the locomotive 11 as the lead railcar 12A approaches the stop location 14, so the operator 15 can stop the train 10 so that the lead railcar 12A is positioned at the stop location 14. The remote control system 30 comprises a sensor 18 positioned relative to the track 13 to detect the presence of the lead railcar 12A on the track 13. The sensor 18 may be mounted on the track 13, e.g., on a cross tie, or positioned wayside the track 13 to detect the lead railcar 12A a predetermined distance from the stop location 14. When the sensor 18 detects the lead railcar 12A on the track 13, the sensor 18 transmits a signal 20 to an off-board controller 19. In response to receiving signal 20 from the sensor 18, the controller 19 transmits a signal 21 to the locomotive 11. The signal 21 is representative of a command or setting that controls movement of the train 10 on the track. Accordingly, responsive to the receipt of signal 21, the locomotive operating system 22 sets a maximum speed setting for the locomotive 11 to travel on the track 13 toward the stop location 14.

In addition, the operating system 22 may command the locomotive 11 to stop on the track 13, and the operator 15 may remotely control the movement of the locomotive 11 and train 10 toward the stop location 14; however, the operator 15 via the remote control unit 16 can not enable the locomotive 11 to travel at a speed that exceeds the maximum speed setting. In such an embodiment, when the operating system 22 of the locomotive 11 commands the locomotive 11 to stop in response to receiving the signal 21 from controller 19, the remote control unit 16 may be configured to require the operator 15 to enter a command before the locomotive 11 can be moved on the track 13. For example, the remote control unit 16 may include an input mechanism for generating a STOP command, which when completed will enable the operator 15 to move the locomotive 11 and train 10 toward the stop location 14.

In one embodiment, the sensor 18 is an electro-optical sensor such as a through-beam sensor or retro-reflective sensor that is hard-wired to the controller 19, which is housed in a control box. The controller 19 also includes a radio frequency module 23 for communicating with and transmitting signals to the communication system 17 of the locomotive 11. Alternatively, the sensor 18 may have wireless communication capabilities for transmitting signals to the controller 19. In another embodiment, the controller 19 may be integrated with or be a component of the remote control unit 16. In either case, the remote control unit 16 has an operator interface that enables the operator 15 to activate the system so that the operating system 22 on the locomotive 11 can not respond to speed setting commands that exceed the maximum speed setting for the locomotive 11 after the sensor 18 is tripped by the lead railcar 12A.

The speed setting selected may be an arbitrary setting, e.g., 1 mph (1.609 kilometers/hour) for any train 10 and locomotive 11 entering the track 13, or the controller 19 and/or onboard operating system 22 may be programmed to determine the maximum speed setting for a given train 10. When an operator 15 engages the system or activates the controller 19, the controller 19 may prompt the operator 15 to enter data relative to the locomotive 11 and train 10, such as tonnage data, to determine the maximum speed setting. In addition, the controller 19 or onboard operating system 22 may be configured with an algorithm that also factors in the distance the lead railcar 12A must travel to reach the stop location 14 and the grade of the track 13 to determine the speed setting.

In an embodiment, when the lead railcar 12A enters the track 13, an operator engages the controller 19 for linking the controller 19 to the onboard communication system 17 and operating system 22. Radio frequency communication systems are commonly used at rail yards for radio communications between off-board components (such as a remote control unit) and on-board components. Accordingly, one skilled in the art would appreciate how a wayside controller can be linked to an onboard communication system, considering in part the frequency range of the communication system. When the controller 19 is linked to the locomotive communication system 17 and operating system 22, the controller may transmit data via a radio signal indicative of a track identifier. The operating system 22 may include a database that includes data about the location or identification of the sensor 18 (or a plurality of sensors as described below) on the track 13 and data relative to one or more maximum speed settings associated with each sensor 18 location. Accordingly, when the operating system 22 receives signal 21 indicating that the lead railcar has been detected on the track 13, the operating system 22 accesses the database to determine, select, or command a maximum speed setting associated with the sensor 18.

Alternatively, the controller 19 may be programmed and/or configured so that the signal 21 includes a maximum speed setting command. The controller 19 may access a database (not shown) that includes one or maximum speed settings associated with the sensor 18, or one or more speed settings associated with each of a plurality of sensors (described below). When the sensor 18 detects the railcar 12A on the track 13, the controller, via the module 23, transmits a signal or command indicative of the maximum speed setting for the locomotive 11 traveling toward the stop location 14.

Figure 2:
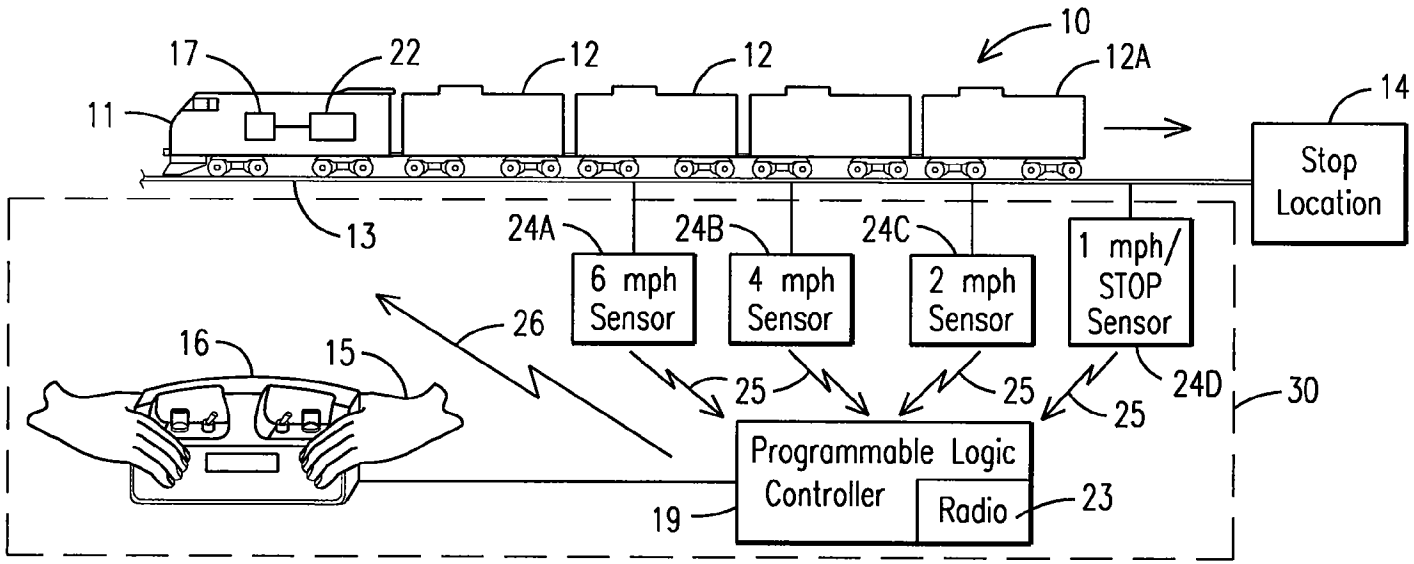
FIG. 2 is a schematic illustration of a second embodiment of the invention.

A second embodiment of the invention is shown in FIG. 2 and includes a plurality of sensors 24A-24D positioned relative to the track 13 to detect the lead railcar 12A on the track 13. As shown, the sensors 24A-24D are spaced apart from one another and each is spaced a different predetermined distance from the stop location 14 for the lead railcar 12A. Each sensor 24A-24D transmits a signal 25 to the controller 19 when the lead railcar 12A is detected on the track 13. As indicated above, the controller 19 may incorporate a database that includes data relative to at least one maximum speed setting, and each speed limit is associated with a respective sensor 24A-24D. When the controller 19 receives signal 25 from one of the sensors 24A-24D, the controller 19 transmits a signal 26 to the onboard communication system represented by the module 17 and the onboard operating system 22. The signal 26 is indicative of a maximum speed setting for the locomotive 11 traveling on the track 13 toward the stop location 14. The operating system 22 then automatically sets the maximum speed setting responsive to the signal 26.

This maximum speed setting overrides any speed setting that exceeds the maximum speed setting input by the operator 15 via the remote control unit 16; however, the operator 15 may be able to set speed settings that are less than the maximum speed setting. In an embodiment, the maximum speed setting entered by the operating system 22 may be associated with only the direction of movement toward the stop location 14; so the operator 15 may command any speed in the "pull" direction away from the stop location 14. In reference to FIGS. 1 and 2, when the operating system 22 and onboard communication system 17 receive signals 21 and 26 from the controller 19, the maximum speed setting is entered for the locomotive 11 traveling in reverse; and, the operator 15 may command speeds exceeding the maximum speed setting for the locomotive 11 traveling forward.

With respect to the embodiment shown in FIG. 2, the maximum speed setting may be reduced as the locomotive 11 approaches the stop location. Accordingly, when each sensor 24A-24D is tripped by the lead railcar 12A and the controller 19 transmits signal 26 to the onboard operating system 22 and communication system 17, the maximum speed setting is entered and maintained until the controller 19 transmits a subsequent signal 26 responsive to the lead railcar 12A being detected by the next sensor, thereby reducing the maximum speed setting. For example, when sensor 24A is activated the signal 26 may be indicative of a 6 mph (9.656 kilometers/hour) maximum speed setting; and, when the next sensor 24B is activated the signal 26 is indicative of a 4 mph (6.437 kilometers/hour) maximum speed setting.

In an embodiment, when sensor 24D or the sensor closest to the stop location 14 detects the lead railcar 12A on the track 13, the signal 26 may include a STOP command and a maximum speed setting (e.g., one mile per hour). As described above, the remote control unit 16 may be configured such that once the train 10 and locomotive 11 have stopped; the operator 15 may input a command to move the locomotive 11 further toward the stop location 14. In this manner, the operator may control movement of the locomotive 11 and train 10 toward the stop location 14 so the lead railcar 12 is properly positioned at the stop location 14 for loading or unloading cargo, and the lead railcar 12A does not overrun the stop location, potentially colliding with the loading dock, building, and/or nearby equipment.

As described above, in one embodiment the onboard operating system 22 may be configured to identify the track 13 and the distance between each sensor 24A-24D and/or the distance from each sensor 24A-24D (sensor 18 in FIG. 1) to the stop location. When the controller 19 is initially linked to the onboard communication system 17, the controller 19 may transmit data relative to the track 13 identification and data relative to the distance the sensors 24A-24D (sensor 18 in FIG. 1) are spaced relative to each other and relative to the stop location 14. Alternatively, the onboard operating system 22 may access a database that includes data relative to the distances the sensors 24A-24D are spaced from each other and from the stop location, which data is associated with a track identification name or number. In addition, the database may include, or the controller 19 may transmit data relative to a maximum speed setting for each sensor 24A-24D (sensor 18 in FIG. 1) or for one or more predetermined distances from the stop location, and a distance at which a STOP command is initiated by the operating system 22. When the controller 19 is linked to the onboard operating system 22 and communication system 17 and transmits the track identification data, the onboard operating system 22 may access sensor distance data.

In this manner, in the event there is a communication loss between the locomotive 11 and the controller 19, or if one or more of the sensors 24A-24D (and sensor 18 in FIG. 1) fails, the operating system 22 may initiate the speed setting commands to set a maximum speed setting at a distance a sensor 18, 24A-24D is spaced from the stop location. Alternatively, if there is a communication loss between controller 19 and the locomotive 11, the operating system 22 may initiate a STOP command so the operator 15 may disable the remote control system 30. As known to those skilled in the art, in RF communications systems, signals may be transmitted between communication modules to confirm that a communication link is available or whether there has been an interruption of a communication link. Once the locomotive communication system 17 and the wayside controller 19 are "linked," there may be periodic communication between these components 17 and 19. A communication loss fault will be declared if this periodic communication is interrupted, forcing the operator 15 to take control of the movement manually.

Figure 3:
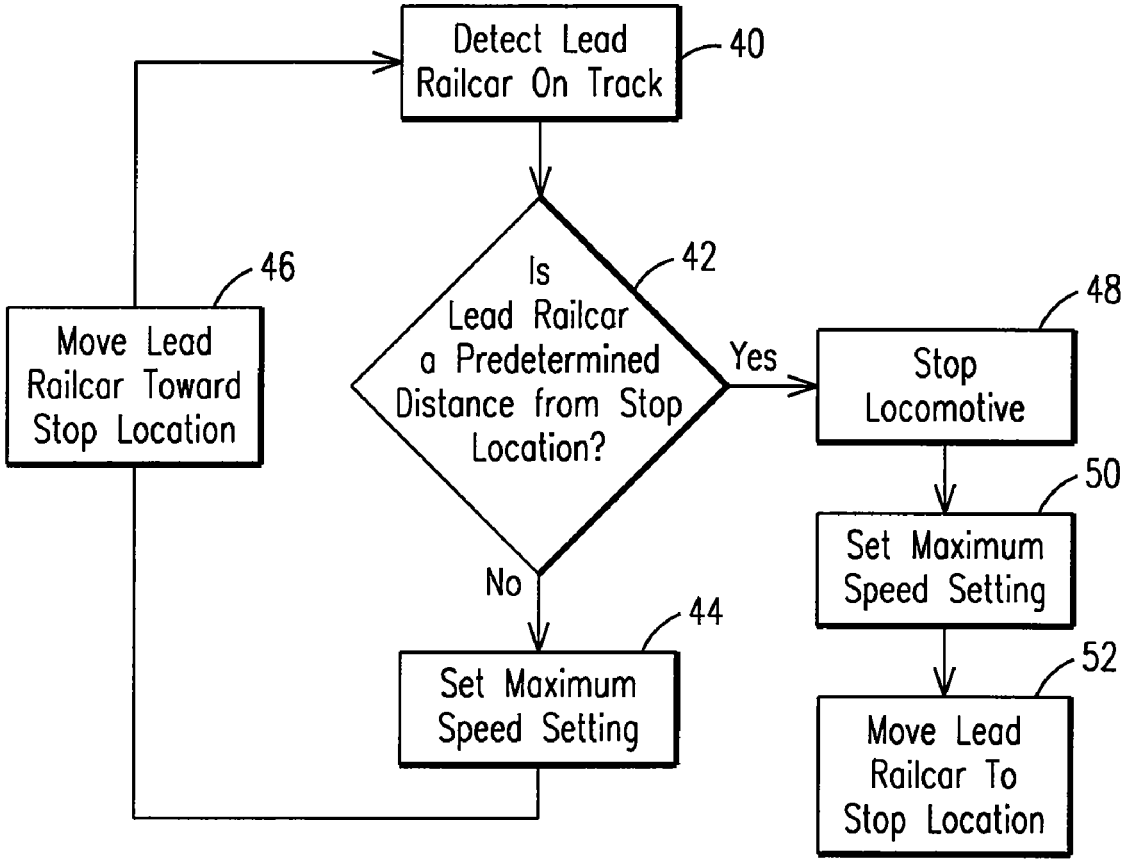
FIG. 3 is a flow chart showing steps for a method embodiment of the invention.

Embodiments of the invention may also be described as a method or computer program. With respect to FIG. 3 there is a flow chart showing different steps of a method, which steps may also be characterized as computer modules for a computer program. An embodiment of the invention may be described as comprising the step 40 of first detecting the lead railcar 12A on the track 13 a distance from the stop location; and then in step 44 setting a maximum speed setting for the locomotive 11 to travel toward the stop location.

In step 42 the controller 19 or the onboard operating system 22 determines whether the lead railcar 12A is a predetermined distance from the stop location 14 in order to stop the locomotive 11. As described above in an embodiment of the invention utilizing a single sensor 18, in step 48 the operating system 22 may respond to a signal received from the controller 19 by commanding the locomotive to stop a distance from the stop location 14 before operator 15 can control movement of the train 10 to the stop location 14. Alternatively, in an embodiment utilizing a plurality of sensors 24A-24A, the operating system 22 may command the locomotive 11 to stop (step 48) when the last sensor 24D closest to the stop location 14 is tripped. In either case, in step 50 the operating system 22 sets a maximum speed setting at which the locomotive 11 may travel toward the stop location; and, in step 52 an operator 15 remotely controls the movement of the train 10 so the lead railcar 12A is positioned at the stop location 14.

If the lead railcar 12A is not a predetermined distance from the stop location 14, or a STOP command is not initiated, the locomotive operating system 22 still enters a maximum speed setting in step 44. In step 46, the locomotive 11 continues to push the railcars 12 toward the stop location 14 until a signal is received that indicates that the lead railcar 12A is at the predetermined distance from the stop location. In this manner, the operator can control movement of the train, including the locomotive 11 and lead railcar 12A, to the stop location 14 at a safe speed without overrunning the stop location 14.

Embodiments described above may be implemented on a suitable computer system, controller, memory, or generally a computer readable medium. For example, the steps of the methods described above may correspond to computer instructions, logic, software code, or other computer modules disposed on the computer readable medium, e.g., floppy disc, hard drive, ASIC, remote storage, optical disc, or the like. The computer-implemented methods and/or computer code may be programmed into an electronic control unit of an engine, a main control system of the locomotive, a remote control station that communicates with the locomotive unit, or the like, as described above.

While various embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

What is claimed is:

1. A remote control system comprising:

at least one sensor configured to be positioned relative to a pathway for detecting a presence of a lead vehicle in a series of connected vehicles that travel on the pathway and that includes a powered vehicle for moving the series of connected vehicles, the at least one sensor spaced a distance from a stop location of the lead vehicle and configured to transmit a first signal when the lead vehicle is detected on the pathway; and an off-board controller configured to receive the first signal from the at least one sensor and to be in communication with an operating system disposed onboard the powered vehicle, the controller also configured to transmit a second signal that is based on the first signal to the powered vehicle when the lead vehicle is detected by the sensor, wherein the controller is configured to transmit the second signal in order to cause the operating system on the powered vehicle to establish a speed limit setting for the powered vehicle that prevents the powered vehicle from traveling on the designated pathway toward the stop location at a speed that is faster than the speed limit setting.

2. The remote control system of claim 1, wherein the powered vehicle is pulling the series of connected vehicles and the powered vehicle is the lead vehicle of the series of connected vehicles.

3. The remote control system of claim 1, wherein the powered vehicle is pushing the series of connected vehicles and the lead vehicle is disposed at a distal end of the series of connected vehicles relative to the powered vehicle.

4. The remote control system of claim 1, wherein the controller is configured to transmit the second signal to the operating system on the powered vehicle in order to command the powered vehicle to stop so that the lead vehicle is stopped a distance from the stop location when the operating system receives the second signal, and wherein the controller is configured to transmit the second signal so that the lead vehicle cannot exceed the speed limit setting traveling from a location where the lead vehicle stops toward the stop location.

5. The remote control system of claim 1, wherein the at least one sensor includes a plurality of sensors configured to be spaced apart from each other along the designated pathway at different distances from the stop location for detecting the presence of one or more of the vehicles in the series of vehicles on the designated pathway, and wherein the plurality of sensors is configured to transmit the first signal to the controller when the lead vehicle is detected on the designated pathway.

6. The remote control system of claim 5, wherein the plurality of sensors includes at least a first sensor and at least a second sensor positioned between the first sensor and the stop location, and wherein the controller is configured to transmit the second signal to the operating system disposed onboard the powered vehicle to establish a first speed limit setting when the first sensor detects the lead vehicle on the designated pathway and a slower, second speed limit setting of the powered vehicle when the second sensor detects the lead vehicle on the designated pathway.

7. The remote control system of claim 1, wherein the controller is configured to be a component of an off-board remote control unit having an operator interface that includes an input mechanism to remotely control movement of the powered vehicle and to activate the controller to provide the second signal to the operating system of the powered vehicle when the at least one sensor detects the lead vehicle on the designated pathway, the controller configured to transmit the second signal so that the operating system of the powered vehicle to prevent the operating system from responding to commands sent from the off-board remote control that direct the operating system to cause the powered vehicle to exceed the speed limit setting sent from the controller.

8. The remote control system of claim 7, wherein the operating system of the powered vehicle is configured not to respond to the commands from the off-board remote control unit that direct the operating system to exceed the speed limit setting when the powered vehicle is moving in a first direction, the operating system also configured to respond to the commands from the off-board remote control unit that direct the operating system to exceed the speed limit setting when the powered vehicle is moving in a different, second direction.

9. The remote control system of claim 1, wherein the controller is configured to be positioned wayside of the designated pathway as a component that is separate from a remote control unit that is used by an operator to remotely control movement of the powered vehicle on the designated pathway, and the operating system disposed onboard the powered vehicle is configured to not respond to commands from the controller to exceed the speed limit setting.

10. The remote control system of claim 9, wherein the operating system of the powered vehicle is configured to not respond to the commands from the controller to exceed the speed limit setting when the powered vehicle is moving in a first direction but is configured to respond to the commands to exceed the speed limit setting when the powered vehicle moving in a different, second direction.

11. The remote control system of claim 1, wherein the operating system of the powered vehicle accesses data relative to an identification of the designated pathway and data relative to one or more speed limit settings associated with one or more distances that the lead vehicle is spaced from the stop location.

12. The remote control system of claim 11, wherein the operating system of the powered vehicle accesses data relative to a location that the lead vehicle is stopped a distance from the stop location and the speed limit setting for the powered vehicle to travel toward the stop location.

13. The remote control system of claim 1, wherein the powered vehicle is a locomotive and the vehicles in the series of connected vehicles are a plurality of railcars linked together and to the locomotive, and the designated pathway is a railroad track.

14. The remote control system of claim 13, wherein the locomotive is pushing the railcars and the lead vehicle is a railcar disposed at a distal end of the series of railcars relative to the locomotive.

15. A method comprising:

detecting a presence of a lead railcar in a train having at least one locomotive on a track at a predetermined distance from a stop location of the lead railcar, the at least one locomotive being remotely controlled from an off-board remote control unit;

transmitting a first signal to the remote control unit in response to the presence of the lead railcar being detected; and setting a speed limit setting of the at least one locomotive with an operating system disposed onboard the at least one locomotive, the speed limit setting based on a second signal that is transmitted from the remote control unit to the operating system, the second signal transmitted by the remote control unit in response to the remote control unit receiving the first signal, wherein the speed limit setting prevents the at least one locomotive from traveling at speeds faster than the speed limit setting over the predetermined distance to the stop location.

16. The method of claim 15, further comprising detecting the lead railcar at plural different locations on the track, wherein setting the speed limit setting of the at least one locomotive comprises setting a different speed limit setting each time the lead railcar is detected on the track at each of the different locations.

17. The method of claim 16, wherein the different locations are associated with different speed limit settings, the different locations disposed closer to the stop location associated with slower speed limit settings than the different locations disposed farther from the stop location.

18. The method of claim 15, further comprising directing the at least one locomotive to stop the predetermined distance from the stop location in response to the presence of the lead railcar being detected on the track.

19. The method of claim 15, further comprising preventing the remote control unit from directing the at least one locomotive to exceed the speed limit setting when the at least one locomotive is moving the train responsive to commands from the remote control unit to control movement of the at least one locomotive.

20. The method of claim 19, wherein preventing the remote control unit from directing the at least one locomotive to exceed the speed limit setting applies when the at least one locomotive is moving toward the stop location, and further comprising allowing the remote control unit to direct the at least one locomotive to exceed the speed limit setting when the at least one locomotive is moving the train away from the stop location.

21. A computer readable memory medium configured to store a program for remotely controlling movement of a train having at least one locomotive having an onboard operating system and moving plural railcars that include a lead railcar linked at an end of the railcars distal to the at least one locomotive, the computer readable memory medium comprising one or more computer modules configured to direct a controller of a remote control unit to:

detect a presence of the lead railcar on a track at a predetermined distance from a stop location of the lead railcar, the presence of the lead railcar detected based on a first signal received from a sensor disposed alongside a track on which the train is moving; and communicate a second signal to the operating system that is onboard the at least one locomotive to cause the operating system to set a speed limit setting of the at least one locomotive responsive to receiving the first signal at the remote control unit, the second signal received by the operating system to prevent the at least one locomotive from moving the railcars on the track over the predetermined distance from a detection location where the lead railcar is detected on the track to the stop location at speeds that exceed the speed limit setting.

22. The computer readable memory medium of claim 21, wherein the one or more computer modules are configured to direct the controller to:

detect the lead railcar at plural different locations on the track spaced at different distances from the stop location; and set the speed limit setting of the at least one locomotive each time the lead railcar is detected on the track at the different locations, wherein the speed limit setting is based on the distance that the location at which the railcar is detected is spaced from the stop location.

23. The computer readable memory medium of claim 22, wherein the speed limit settings are associated with the different locations, the speed limit settings for the different locations disposed closer to the stop location being slower than the speed limit settings for the different locations disposed farther from the stop location.

24. The computer readable memory medium of claim 21, wherein the one or more computer modules are configured to direct the controller to remotely control the at least one locomotive in order to stop the at least one locomotive at the predetermined distance from the stop location.

25. The computer readable memory medium of claim 21, wherein the one or more computer modules are configured to direct the controller to control movement of the at least one locomotive and prevent the controller from directing the locomotive to travel at the speed that exceed the speed limit setting.

26. The computer readable memory medium of claim 25, wherein the one or more computer modules that are configured to direct the controller to control the movement of the at least one locomotive prevent the controller from directing the at least one locomotive to exceed the speed limit setting when traveling toward the stop location but allow the controller to direct the at least one locomotive to exceed the speed limit setting when traveling away from the stop location.

27. A remote control system comprising:

a sensor configured to detect a presence of a powered vehicle traveling along a pathway at a location that is spaced a distance from a designated stop location along a pathway, the sensor also configured to transmit a first signal when the powered vehicle is detected, the powered vehicle configured to stop along the pathway at the designated stop location; and a controller configured to receive the first signal and to be in communication with an onboard operating system of the powered vehicle, the controller configured to transmit a second signal to the operating system of the powered vehicle when the powered vehicle is detected, wherein the operating system is configured to set a speed limit setting for the powered vehicle in response to receiving the second signal and is further configured to control a speed of the powered vehicle so not to exceed the speed limit setting as the powered vehicle approaches and stops at the designated stop location.

28. The remote control system of claim 1, wherein the controller is configured to transmit the second signal to establish the speed limit that differs from a designated pathway speed limit of the designated pathway.

29. The remote control system of claim 1, wherein the controller is configured to remotely control movement of the powered vehicle with a speed of the powered vehicle that is controlled by the controller being limited based on the presence of the lead vehicle that is detected at the at least one sensor.

30. The remote control system of claim 1, wherein the controller is configured to obtain vehicle data relative to at least one of the powered vehicle or the series of connected vehicles and to determine the speed limit setting for the powered vehicle based on the distance from the stop location and the vehicle data.

31. The remote control system of claim 30, wherein the vehicle data includes weight of the at least one of the powered vehicle or the series of connected vehicles.

32. The remote control system of claim 1, wherein the at least one sensor includes plural sensors disposed at different locations along the designated pathway and the controller is included in a remote control unit disposed off-board the powered vehicle and configured to control movement of the powered vehicle, further wherein the controller includes a database that associates different speed limit settings with the different locations of the sensors, and wherein the controller is configured to obtain the speed limit setting associated with the location of the sensor that detected the presence of the lead vehicle from the database and transmit the speed limit setting that is obtained to the operating system disposed onboard the powered vehicle.

33. The remote control system of claim 1, wherein the at least one sensor includes plural sensors disposed at different locations along the designated pathway and the operating system disposed onboard the powered vehicle includes a database that associates different speed limit settings with one or more of the different locations of the sensors or different identifiers of the sensors, and wherein the controller is configured to transmit the second signal as an indication of at least one of the location or the identifier of the sensor that detected the presence of the lead vehicle so that the operating system can determine the speed limit setting associated with the sensor that detected the presence of the lead vehicle.

34. The method of claim 15, further comprising obtaining vehicle data relative to at least one of the locomotive or the train and to determine the speed limit setting for the locomotive based on the distance from the stop location and the vehicle data.

35. The method of claim 34, wherein the vehicle data includes weight of the locomotive or the train.

36. The remote control system of claim 1, wherein the second signal that is transmitted to the operating system of the powered vehicle includes the speed limit setting.

37. The remote control system of claim 1, wherein the off-board controller is configured to reduce the speed limit setting established by the operating system of the powered vehicle as the powered vehicle moves closer to the stop location.

38. The remote control system of claim 27, wherein the second signal that is transmitted to the operating system of the powered vehicle includes the speed limit setting.

39. The remote control system of claim 27, wherein the controller is configured to reduce the speed limit setting established by the operating system of the powered vehicle as the powered vehicle moves closer to the stop location.

* * * * *